US005711193A

United States Patent [19]

Eggert et al.

[11] Patent Number: 5,711,193

[45] Date of Patent: Jan. 27, 1998

[54] REVERSIBLE RATCHETING SCREWDRIVER WITH IMPROVED REVERSING RING

[75] Inventors: Daniel M. Eggert, Kenosha; Christopher D. Thompson, Milwaukee, both of Wis.

[73] Assignee: Snap-on Technologies, Inc., Crystal Lake, Ill.

[21] Appl. No.: 562,077

[22] Filed: Nov. 22, 1995

Related U.S. Application Data

[63] Continuation-in-part of Ser. No. 395,063, Feb. 27, 1995, Pat. No. 5,520,073.

[51] Int. Cl.[6] ..... B25B 13/46

[52] U.S. Cl. ..... 81/63.1; 81/58.1; 81/63.2

[58] Field of Search ..... 81/63.1, 58.1, 81/63.2, 62, 490, 60, 61

[56] References Cited

U.S. PATENT DOCUMENTS

| | | | |
|---|---|---|---|
| 794,952 | 7/1905 | Schroeder | 81/58.1 |
| 897,584 | 9/1908 | Carlson | 81/63.1 |
| 3,691,876 | 9/1972 | Cassidy, Jr. | 81/58.1 |
| 4,735,120 | 4/1988 | Beugelsdyk | 81/63.1 |
| 4,777,852 | 10/1988 | Herman et al. | 81/63.1 |
| 4,791,837 | 12/1988 | Main | 81/63.1 |
| 5,142,953 | 9/1992 | Lin | 81/63.2 |
| 5,437,212 | 8/1995 | Thompson et al. | 81/63.1 |
| 5,520,073 | 5/1996 | Bakula et al. | 81/63.1 |

OTHER PUBLICATIONS

Snap-on, Inc. 1994 Catalog, pp. 45 (Item P) and 83 (Item X).

05711877

*Primary Examiner*—Willis Little
*Attorney, Agent, or Firm*—Emrich & Dithmar

[57] ABSTRACT

The ratcheting screwdriver comprises a handle with a working end and a reversible ratchet mechanism therein, the ratchet mechanism defining a bore which receives one end of an associated shank coaxially therein. A cup-shaped spinner is fixed to the shank and a cup-shaped reversing member is nested in the spinner and is coupled to the ratchet mechanism and has an annular flange engageable by a finger and/or thumb of a user's hand which is gripping the handle for shifting the ratchet mechanism among forward ratcheting, reversing ratcheting and non-ratcheting modes. The outer peripheral surface of the annular flange has circumferentially alternating arcuate recesses and serrated frictional griping regions. In several embodiments, at least one of the serrated regions is in the form of a raised lobe which projects radially outwardly beyond the remainder of the flange surface and radially beyond the working end of the handle, the lobe having an arcuate outer surface with serrations extending along the sloping sides and along the crest of the surface. At least one such lobe is preferably positioned along the top of the handle and the lobes may have axial extents greater than that of the remainder of the annular flange.

25 Claims, 2 Drawing Sheets

REVERSIBLE RATCHETING SCREWDRIVER WITH IMPROVED REVERSING RING

CROSS-REFERENCE TO RELATED APPLICATION

This application is a continuation-in-part of application Ser. No. 395,063, filed Feb. 27, 1995 now U.S. Pat. No. 5,520,073, issued May 28, 1996, and entitled "Reversible Ratcheting Screwdriver with Spinner and Ergonomic Handle".

BACKGROUND OF THE INVENTION

1. Field of the Invention

This invention relates to ratcheting drivers of the type used for driving screws, nuts and the like and, in particular, to reversible ratcheting drivers.

2. Description of the Prior Art

The present invention is an improvement of the reversible ratcheting screwdriver disclosed in U.S. Pat. No. 4,777,852, the disclosure of which is incorporated herein by reference. That screwdriver has an elongated handle and a ratchet mechanism carried by a working end of the handle. The ratchet mechanism includes a gear engageable with a pair of pawls, the gear having an axial bore which receives one end of an associated shank. A control cap surrounds the ratchet mechanism and receives the shank through an opening therein, the cap being retained in place by a split ring and being rotatable to actuate a reversing mechanism to shift the ratchet mechanism among forward and reverse ratcheting modes and a non-ratcheting mode. The control cap has a knurled outer circumferential surface which has a maximum outer diameter substantially the same as that of the working end of the handle. The shank has a knurled portion so that a user, while gripping the handle with one hand, can spin the shank relative to the handle by grasping the knurled portion of the shank with the other hand. Such a spinning operation is utilized during low-resistance portions of the driving operation of an associated fastener, such as during the early stages of tightening a fastener or the late stages of loosening a fastener.

This prior arrangement is inconvenient, because it requires that the user employ both hands in order to effect the spinning operation of the shank. Also, the prior ratcheting screwdriver has a standard elongated straight handle. This arrangement can make it difficult and uncomfortable for the user to apply high torquing forces to an associated fastener or other type of workpiece, since it affords a very small moment arm for the torquing force application. Also, because this configuration requires the user+s wrist to be extended in an unnatural manner, applications which require repeated operations over long periods of time can be physically tiring and/or painful for a user's wrist.

SUMMARY OF THE INVENTION

It is a general object of this invention to provide an improved ratcheting driver which avoids the disadvantages of prior ratcheting drivers while affording additional structural and operating advantages.

A still further feature of the invention is to provide a ratcheting driver of the type set forth, which has an ergonomically designed handle.

Yet another feature of the invention is the provision of a reversible ratcheting driver with a reversing member which is easily operable by the finger and/or thumb of a user's hand which is gripping the handle.

Still another feature of the invention is the provision of a reversible ratcheting driver of the set forth, which is of relatively simple and economical construction.

These and other features of the invention are attained by providing in a ratcheting driver including a handle having a generally cylindrical working end with a predetermined radius, a reversible ratchet mechanism carried by the working end of the handle and operable in forward and reverse ratcheting modes, the ratchet mechanism defining a bore having an axis, and an elongated shank receivable coaxially in the bore and engageable with the ratchet mechanism and responsive to rotation of the handle for rotation with the handle in a first direction and for ratcheting rotation relative to the handle in a second direction opposite to the first direction, wherein the first direction is either a forward direction or a reverse direction depending on the ratcheting mode, the improvement comprising: a cylindrical reversing member disposed adjacent to the working end of the handle coaxially with the bore for rotation relative to the shank and coupled to the ratchet mechanism for shifting between the forward and reverse ratcheting modes, the reversing member having an exposed outer peripheral surface including a raised lobe portion projecting radially outwardly beyond the working end of the handle a predetermined distance sufficient to permit easy rotation of the reversing member by engagement of the lobe portion with the finger and/or thumb of a user's hand gripping the handle.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENT

Figure 1:
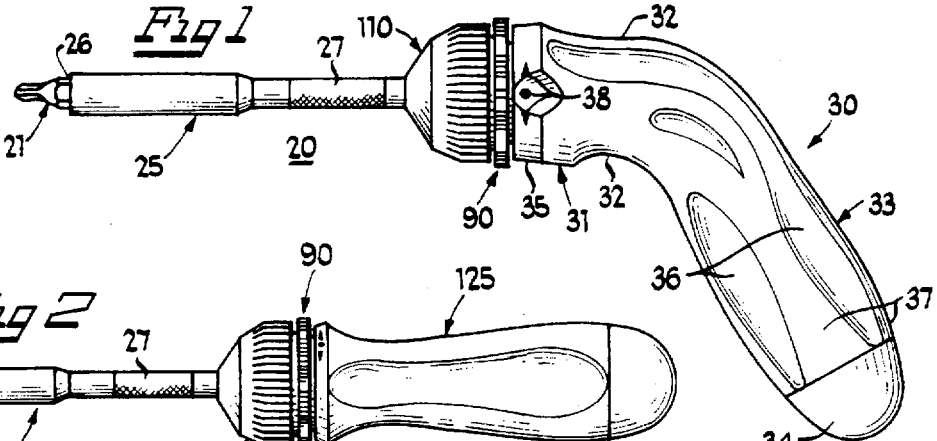
FIG. 1 is a side elevational view of a reversible ratcheting screwdriver in accordance with a first embodiment of the present invention.
Figure 3:
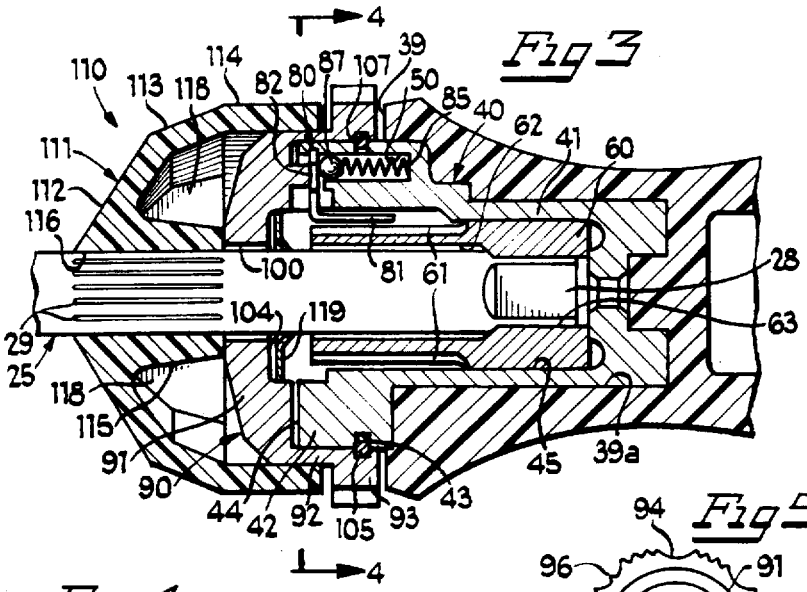
FIG. 3 is an enlarged, fragmentary, sectional view of the ratchet and reversing mechanisms of the screwdrivers of FIGS. 1 and 2.
Figure 5:
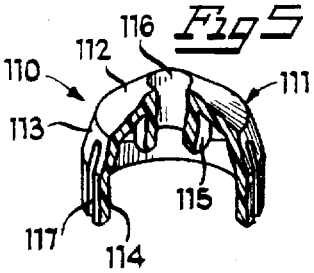
FIG. 5 is an enlarged, perspective view in partial section of the spinner of the screwdrivers of FIGS. 1 and 2.

Turning now to the drawings and, more particularly, to FIG. 1 thereof, there is depicted a ratcheting screwdriver 20 incorporating the features of the present invention. The screwdriver 20 carries a removable bit 21 for use in driving a Phillips® screw. Various designs of bits well known in the industry may be substituted for the bit shown. The screwdriver 20 includes a shank 25 having an enlarged end defining a receptacle 26 for the bit 21. Within the receptacle 26 is a magnet (not shown) to which the bit 21 is attracted and thereby removably held. The shank 25 has a portion with a knurled surface 27 to facilitate gripping by the user. Referring also to FIG. 3, the shank 25 is circular in cross section along most of its length but has a square end 28 opposite the receptacle 26. Longitudinally extending knurls or splines 29 may be provided on the shank 25 a slight distance axially from the square end 28 for a purpose to be described below.

The shank 25 is mounted in an elongated handle 30 which is bent generally into a "pistol grip" configuration. More specifically, the handle 30 has a short forward portion 31 which extends along a first axis and is coupled by a necked-down bend portion 32 to an elongated grip portion 33, which extends along a second axis inclined at an angle of approximately 120° to the axis of the forward portion 31. The distal end of the grip portion 33 is provided with a cap or cover 34 which may be unscrewed to expose a compartment (not shown) in which bits may be stored. The forward portion 31 of the handle 30 terminates in a working end 35. The grip portion 33 has four slightly concave surfaces 36 separated by four convex surfaces 37, which design facilitates gripping of the handle 30. On the working end 35 are indicia 38 consisting of a pair of oppositely directed arrows and a dot between the arrows. Each arrow signifies that the screwdriver 20 is rotated in that direction and is ratcheted in the opposite direction. The center dot signifies the position in which the screwdriver 20 functions without any ratcheting. The working end 35 has a substantially circular end surface 39 in which is formed an axial bore **39*a*** (FIG. 3).

Figure 4:
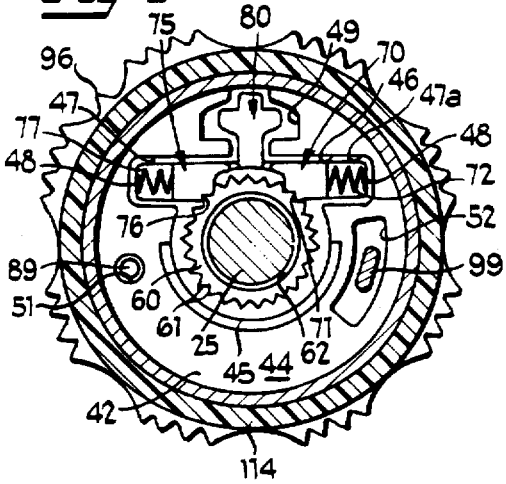
FIG. 4 is a view in vertical section taken along the line 4—4 in FIG. 3.

Referring to FIGS. 3 and 4, the handle 30 carries a reversible ratchet assembly 40 which is essentially the same as that disclosed in U.S. Pat. No. 4,777,852. In particular, a metal insert 41 is mounted in the bore **39*a* in the forward portion 31 of the handle 30. The handle 30 is preferably constructed of high impact plastic and the insert 41 is molded in place. The sides of the insert 41 define flange-like elements (not shown) to enable secure retention in the plastic handle. The insert 41 has an enlarged forward end portion 42 about which a circumferential groove 43 is provided, used for locking purposes as will be described. Referring also to FIG. 4, the forward end portion 42 has a circular end surface 44 in which is formed an axial bore 45 which is generally cylindrical in shape and the axis of which is collinear with the longitudinal axis of the forward portion 31 of the handle 30. The insert 41 also has a keyway 46 which communicates with the bore 45 and is generally tangent thereto. The keyway 46 has arm portions 47 and 47*a* on opposite sides of the bore 42. The ends of the keyway 46 are defined by two end surfaces 48 which face each other and are generally parallel to each other and to the axis of the bore 45. A generally cruciform recess 49 is also formed in the end surface 44. In the bottom surface of the recess 49 is an axially extending hole 50. An axially extending hole 51 is formed in the end surface 44 but spaced from the hole 50 about 100°. An arcuate slot 52 is formed in the surface 44 and extends approximately from 90° to 135° removed from the hole 50**.

The ratchet assembly 40 further comprises a tubular gear 60 which is generally cylindrical and is located in the bore 45 and is freely rotatable therein. The forward half of the gear 60 has a multiplicity of teeth 61. Extending axially through the tubular gear 60 is an opening 62, the forward portion of which is cylindrical and the rear end of which is square. The shank 25 extends into the opening 62 and the square end 28 mates with the square end 63 of the opening 62. Accordingly, the shank 25 is fixed to the tubular gear 60 so as to rotate therewith.

The ratchet assembly 40 further includes a pawl 70 which has the shape generally of a parallelepiped, except that one edge is replaced with axially extending teeth 71, which teeth have a shape to mesh with the teeth 61 on the tubular gear 60. The pawl 70 is located in the keyway portion **47*a* (FIG. 4). A spring 72 is located between the pawl 70 and the adjacent one of the end surfaces 48. The spring 72 biases the pawl 70 to the left, as viewed in FIG. 3, against the tubular gear 60. The ratchet assembly 40 further comprises a second pawl 75 which has a construction identical to that of the pawl 70. Its teeth 76 are designed also to mesh with the teeth 61 of the tubular gear 60. A spring 77, identical to the spring 72, is disposed between the pawl 75 and the left hand one of the end surfaces 48. The pawl 75 is biased to the right, as viewed in FIG. 4 against the tubular gear 60**.

The pawls 70 and 75 and the gear 60 are configured and operated in a manner to achieve forward and reverse ratcheting modes of operation, as well as a non-ratcheting mode of operation. When the pawls 70 and 75 are both engaged with the tubular ratchet gear 60, as illustrated in FIG. 4, the screwdriver 20 is in a non-ratcheting mode of operation and operates as a standard screwdriver. If the pawl 70 is disengaged, so that only the pawl 75 remains engaged with the tubular gear 60, then rotation of the handle 30 in a forward direction (counterclockwise, as viewed in FIG. 4) will result in rotation of the shank 25 with the handle to torque the associated fastener, whereas when the handle 30 is rotated in the opposite direction it ratchets relative to the shank 25. Conversely, when only the pawl 70 is engaged with the tubular gear 60, the handle 30 drives the shank 25 when it is rotated in a reverse direction (clockwise, as viewed in FIG. 4), and ratchets relative to the shank 25 when it is rotated in the opposite direction. The details of these modes of operation are explained in the aforementioned U.S. Pat. No. 4,777,852 and, therefore, will not be further described herein.

In order to move the pawls 70 and 75 between their engaged and disengaged positions, there is provided a reversing mechanism which includes an actuator 80. The actuator 80 is generally L-shaped, having a lever 81 and an engagement portion 82. The lever 81 extends rearwardly into the keyway 46 between the pawls 70 and 75. The engagement portion 82 is generally cruciform so as to define a radially directed leg and a laterally directed leg. A spring 85 is located in the hole 50, which biases a ball 87 forwardly and against the engagement portion 82 and specifically against the central area thereof. A spring (not shown) is located in the hole 51, which biases a ball 89 forwardly (FIG. 4).

Figure 8:
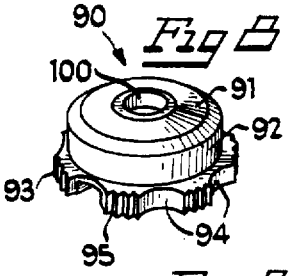
FIG. 8 is a perspective view of the reversing ring of the screwdrivers of FIGS. 1 and 2.
Figure 9:
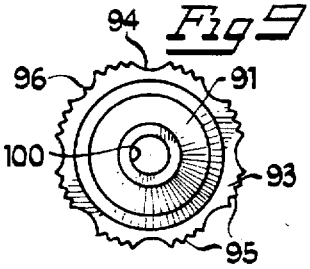
FIG. 9 is a front elevational view of the reversing ring of FIG. 8.
Figure 6:
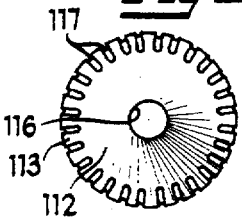
FIG. 6 is a front elevational view of the spinner of FIG. 5.
Figure 10:
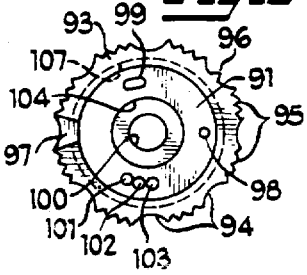
FIG. 10 is a rear elevational view of the reversing ring of FIG. 8.
Figure 7:
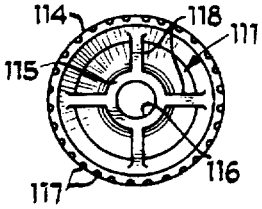
FIG. 7 is a rear elevational view of the spinner of FIG. 5.

Referring also to FIGS. 8–10, the reversing mechanism also includes a reversing ring 90, which is a generally cup-shaped member, preferably formed of metal, which has a generally circular end wall 91 integral at its outer edge with a cylindrical skirt or side wall 92. The opposite end of the side wall 92 is integral with a radially outwardly extending annular flange 93, which is provided with arcuate flutes 94 in its outer surface at circumferentially spaced-apart locations, the outer surface of the flange 93 being knurled or serrated, as at 95, between the flutes 94. Also formed in the outer surface of the flange 93 is an indicator projection 96 (FIG. 9). A radial slot or opening 97 is formed through the flange 93 at one of the flutes 94 (FIG. 10). The sides of the slot 97 preferably flare outwardly as shown. Unitary with the end wall 91 at arcuately spaced locations are a pin 98 and a lug 99 which project from the inner surface of the end wall 91. An axial bore 100 is formed through the end wall 91. Part-spherical detent recesses 101, 102 and 103 are formed in the inner surface of the end wall 91, as is an annular recess 104, which coaxially encircles the inner end of the axial bore 100. The side wall 92 has an inner diameter slightly greater than the outer diameter of the forward end 42 of the metal insert 41 so as to be receivable telescopically thereover. A circumferential groove or recess 107 is formed in the distal end face of the flange 93 at the junction with the side wall 92 for receiving a split-ring retaining spring 105, which is also seated in the groove 43 in the metal insert 41 (FIG. 3) for retaining the reversing ring 90 on the insert 41, as will be explained more fully below.

The ratcheting screwdriver 20 also includes a spinner cap 110, which is a generally cup-shaped member having a compound forward wall 111 which includes a forward frustoconical portion 112 and a rear frustoconical portion 113, the latter joining a cylindrical side wall 114. Unitary with the forward frustoconical portion 112 and projecting rearwardly therefrom is a substantially cylindrical hub 115 having an axial bore 116 formed therethrough. A plurality of circumferentially spaced-apart gripping grooves 117 are formed in the outer surfaces of the cylindrical side wall 114 and the rear frustoconical portion 113 of the forward wall 111. Internally of the cap 110, four equiangularly spaced-apart stiffening ribs 118 extend between the hub 115 and the forward wall 111. The rear end of the hub 115 terminates substantially at the forward end of the cylindrical side wall 114. The inner diameter of the cylindrical side wall 114 is slightly greater than the outer diameter of the side wall 92 of the reversing ring, so as to be telescopically receivable thereover.

In assembly of the ratcheting screwdriver 20, the square end of the shank 25 is first fitted through the axial bore 116 in the spinner cap 110 from front to rear, the splines 29 on the shank 25 being so dimensioned as to provide a press-fit in the hub 115 for fixedly securing the spinner cap 110 to the shank 25. Alternatively, the spinner cap 110 could be molded in place on the shank 25. Next, the square end 28 of the shank 25 is fitted from front to rear through the axial bore 100 in the reversing ring 90, which nests within the spinner cap 110 as illustrated in FIG. 3, the depth of insertion being limited by engagement of the end wall 91 with the hub 115. The parts are so dimensioned that, when thus assembled, the distal edge of the cylindrical side wall 114 of the spinner cap 110 is preferably spaced a very slight distance from the flange 93 of the reversing ring 90 so that the two parts are freely rotatable relative to each other. A lock washer 119 (FIG. 3) is then fitted over the square end 28 of the shank 25 and is received in the annular recess 104 in the reversing ring 90 for cooperation with the hub 115 to axially position the reversing ring 90 on the shank 25.

Next, the retaining spring 105 is seated in the groove 43 of the metal insert 41 and the reversing ring 90 is fitted over the forward end 42 of the metal insert 41. It will be appreciated that the retaining spring 105 has radially extending end portions (not shown) which can be compressed together with the use of a needle-nosed pliers to pull the ring tightly into the groove 43 and allow the reversing ring 90 to be fitted thereover until the spring 105 seats in the reversing ring groove 107. In this regard, the opening 97 in the flange 93 permits access to the spring ends by the pliers. When the spring 105 is released, it expands to seat partially in the metal insert groove 43 and partially in the reversing ring groove 107 for retaining the reversing ring 90 on the metal insert 41 while accommodating relative rotational movement thereof.

It will be appreciated that, as the reversing ring 90 is fitted over the metal insert 41, the square end 28 of the shank 25 is received in the opening 62 of the tubular gear 60 and engages in the square rear end 63 thereof, as illustrated in FIG. 3. When the reversing ring 90 is mounted in place, it is rotationally oriented so that the pin 98 engages the engagement portion 82 of the reversing actuator 80, the lug 99 engages in the arcuate slot 52 to limit rotational movement of the reversing ring 90, the ball 89 seats in the detent recess 102 and the indicator channel 96 aligns with the center indicium dot on the working end 35 of the handle 30. The parts will thus be assembled in the configuration illustrated in FIGS. 3 and 4, with the ratchet assembly 40 disposed in its non-ratcheting mode.

The operation of the ratcheting screwdriver 20 is substantially as was described in the aforementioned U.S. Pat. No. 4,777,852, with the exception of the manipulation of the reversing actuator 80 and the spinning of the shank 25. It will be appreciated that a user will grasp the grip portion 33 of the handle for rotating the handle 30 about the axis of the shank 25. It is a significant aspect of the invention that, because of the pistol-grip configuration of the handle 30, substantial leverage can be exerted for torquing an associated fastener. Also, the pistol grip configuration permits the user to operate the screwdriver 20 substantially with his wrist aligned with his forearm in an ergonomically comfortable manner. It is a further significant aspect of the invention that the outer diameters of the reversing ring flange 93 and the spinner cap side wall 114 are approximately the same as that of the working end 35 of the handle 30. Thus, while the user is grasping the handle 30, he can extend either his thumb and/or a finger of the grasping hand to reach the flange 93 for rotating it to shift the operational mode of the ratchet assembly 40, and/or to spin the spinner cap 110. Thus, it is not necessary for the operator to utilize his other hand to spin the shank 25 (although he could do so if desired, by grasping either the spinner cap 110 or the knurled surface 27 of the shank 25). The fluting and the knurling or serrations on the flange 93 will facilitate operation of the reversing ring 90 and the grooves 117 will facilitate gripping the spinner cap 110. In this regard, the knurled or serrated outer surface portions of the flange 93 extend radially outwardly a slight distance beyond the peripheral outer surfaces of the cylindrical side wall 114 of the spinner cap 110 and the working end 35 of the handle 30, as can best be seen in FIGS. 3 and 4, to facilitate gripping by the thumb and/or forefinger of the user.

Figure 2:
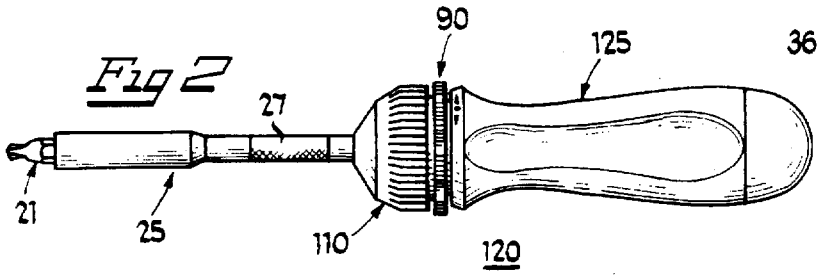
FIG. 2 is a view similar to FIG. 1, on a slightly reduced scale, of a ratcheting screwdriver in accordance with another embodiment of the present invention.

Referring to FIG. 2, there is illustrated a ratcheting screwdriver 120 which is substantially the same as the ratcheting screwdriver 20 of FIG. 1, except that it has a straight handle 125 of the same type which is disclosed in the aforementioned U.S. Pat. No. 4,777,852. Otherwise, the construction and operation of the ratcheting screwdriver 120 are identical to those of the ratcheting screwdriver 20, described above.

In a constructional model of the invention, the spinner cap 110 is preferably formed of a suitable plastic material, as are the handles 30 and 125, while the remaining parts of the screwdrivers are formed of suitable metals.

Figure 11:
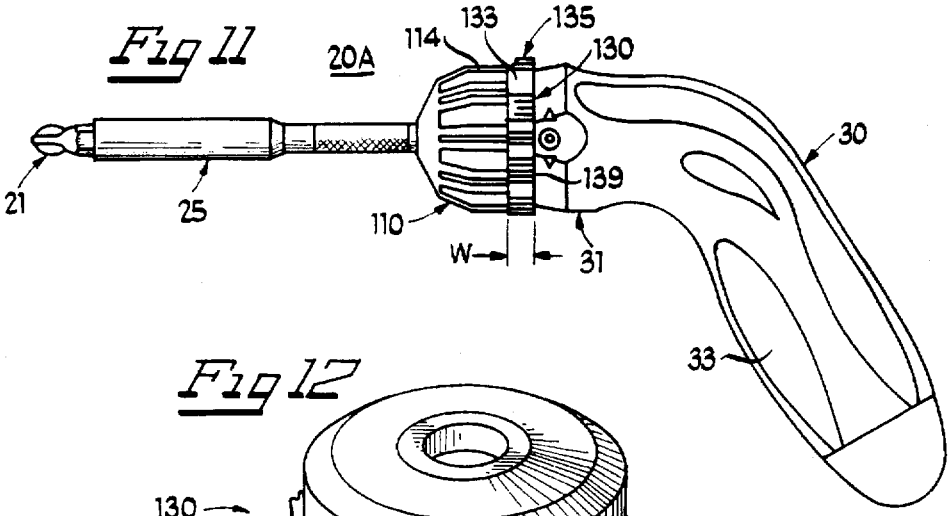
FIG. 11 is a view similar to FIG. 1 of a ratcheting screwdriver incorporating a reversing ring in accordance with another embodiment of the present invention.

Referring now to FIG. 11, there is illustrated a reversible ratcheting screwdriver, designated by the numeral 20A, which is identical to the screwdriver 20 of FIG. 1, except that there has been substituted for the reversing ring 90 a reversing ring 130 in accordance with another embodiment of the invention. The reversing ring 130 is substantially identical to the reversing ring 90 except for the annular flange thereof and, accordingly, only the annular flange details of the reversing ring 130 will be described in detail.

Figure 12:
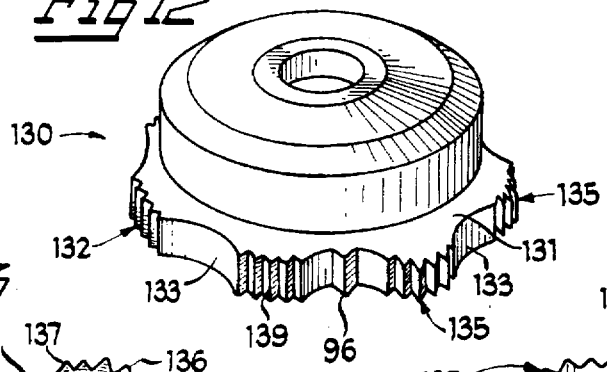
FIG. 12 is an enlarged, perspective view of the reversing ring of the screwdriver of FIG. 11.
Figure 13:
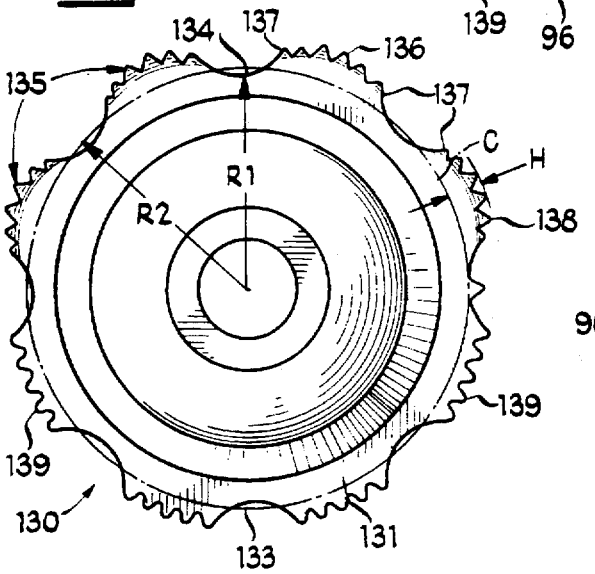
FIG. 13 is a further enlarged, front elevational view of the reversing ring of FIG. 12.
Figure 14:
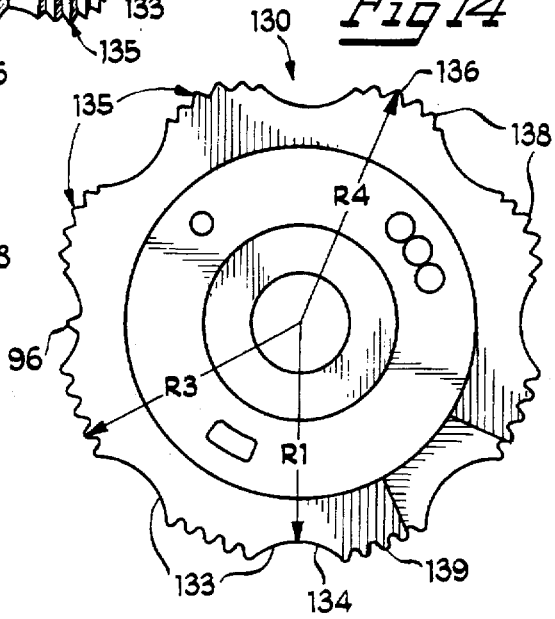
FIG. 14 is a rear elevational view of the reversing ring of FIG. 13.

Referring also to FIGS. 12–14, the reversing ring 130 has a radially outwardly extending annular flange 131, which has an outer peripheral surface 132 characterized by alternating serrated frictional portions and recessed portions or flutes. More particularly, the peripheral surface 132 includes eight substantially equiangularly spaced-apart arcuate recesses or flutes 133, each of which has a root or deepest point 134 which is spaced from the axis of the reversing ring 130 a radial distance R1. As was indicated above, the outer diameters (and radii) of the spinner cap side wall 114 and the working end 35 of the handle 30 are substantially the same, their outer peripheries being indicated by the phantom circle c in FIG. 13 of radius R2. Preferably, the radius R1 is substantially the same as or very slightly less than the radius R2.

Alternating with the recesses 133 along the top half of the flange 131 are four raised lobes 135, each having a convex arcuate outer surface having a crest 136 and sloping sides 137, and including serrations 138 extending along the crest 136 and the sides 137. Alternating with the recesses 133 along the bottom of the flange 131 are four serrated regions 139. The serrated regions 139 are substantially the same as the serrated regions 95 of the reversing ring 90, the crests of the serrations thereof lying along an imaginary circle coaxial with the reversing ring 130 and having a radius R3 (FIG. 14). The crests of the serrations on each of the lobes 135 define an imaginary arc having a radius much smaller than the radius R3, and being spaced at its crest 136 from the axis of the reversing ring 130 by a radial distance R4 (FIG. 14).

As was explained above, the radius R3 of the arc defined by the serrated regions 139 is slightly greater than the radius R1 of the cylindrical side wall 114 of the spinner cap 110 and the working end 35 of the handle 30. However, in order to ensure secure gripping of the reversing ring 130 by the forefinger and/or thumb of the user's hand and easy rotation of the reversing ring 130, the radial distance R4 to the crests 136 of the lobes 135 is greater than the radius R3. In particular, it is a significant aspect of the invention that the radius R4 is such as to provide easy rotation of the reversing ring 130, while not significantly inhibiting rotation of the spinner cap 110 by the thumb and/or forefinger of the user's hand gripping the handle 30. It has been found that it is desirable that the radial distance between the lobe crests 136 and the recess roots 134 (R4-R1) is at least 0.1 times the radial distance R1 from the axis of the reversing ring 130 to the roots 134 of the recesses 133 and, in a preferred embodiment, is approximately 0.14 times R1. In a constructional model of the invention, the lobe crest 136 extends radially outwardly beyond the working end 35 of the handle 30 a distance H (FIG. 13), which is approximately 0.1 inch.

The increased radial outward extend of the lobes 135 accordingly increases the radial distance (R4-R1) between the lobe crests 136 and the recess roots 134 to provide an increased bearing surface height for the user's thumb or forefinger. This fact, together with the fact that the sloping sides 137 of the lobes 135 are serrated provides for significantly increased frictional gripping force and leverage, so that the reversing ring 130 can be easily rotated by the thumb or forefinger of the user's hand gripping the handle 30. Another aspect of the invention is the fact that the axial width W (FIG. 11) of the reversing ring flange 131 is increased as compared with that of the reversing ring 90. Preferably, the width W exceeds 0.2 inch and, in a constructional model of the invention, is substantially 0.234 inch. This further increases the bearing surface for engagement by the user's thumb or forefinger.

Preferably, the reversing ring 130, when mounted in place on the screwdriver 20A, is oriented so that the lobes 135 are disposed on the top side of the screwdriver 20A, as viewed in FIG. 11, i.e., on the side of the handle 30 opposite the side from which the grip portion 33 extends. This orientation will permit the easiest access to the lobes 135 by the thumb of the user's hand which is gripping the grip portion 33 for greatest leverage. While four of the lobes 135 have been illustrated, it will be appreciated that other numbers could be used.

Figure 15:
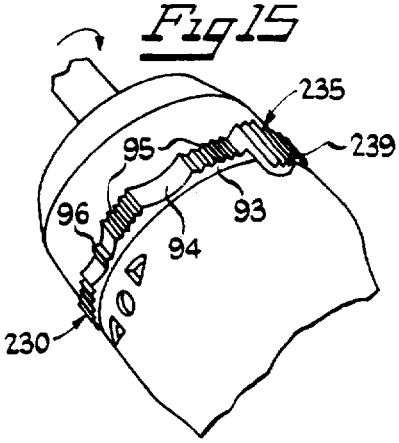
FIG. 15 is a slightly enlarged, fragmentary, perspective view of the screwdriver of FIG. 11 incorporating a reversing ring in accordance with another embodiment of the invention.

Referring now to FIG. 15, there is illustrated another reversing ring 230, which is substantially identical to the reversing ring 90, described above in connection with FIG. 1, so that like parts have like reference numerals. The fundamental difference in the reversing ring 230 is that a lobe or tab 235 has been substituted for one of the arcuate flutes or recesses 94. The lobe 235 is shaped and configured substantially the same as the lobes 135, described above, except that it has an axial extent greater than the axial width of the remainder of the reversing ring flange 131, extending rearwardly beyond the flange 131. The reversing ring 230 is oriented, in use, so that the lobe or tab is positioned on the top of the handle 30 for easy access by the thumb of the user's hand gripping the gripping portion 33.

Figure 16:
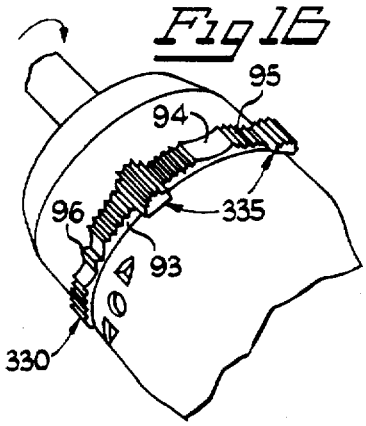
FIG. 16 is a view similar to FIG. 15, illustrating yet another embodiment of the reversing ring of the present invention.

In FIG. 16 there is illustrated a reversing ring 330 in accordance with a still further embodiment of the present invention. The reversing ring 330 is identical to the reversing ring 230 of FIG. 15, except that two of the flutes or recesses 94 have been, respectively, replaced by lobes or tabs 335, each of which is substantially identical to the lobe or tab 235 of FIG. 15. Preferably, the lobes or tabs 335 are spaced apart by one flute or recess 94 and, in use, are disposed on the top of the handle 30 for easy access by the thumb of the user's hand gripping the gripping portion 33.

While the tabs 235 and 335 are preferably disposed on the top of the handle 30, it will be appreciated that they could be disposed in other locations. Also, it will be understood that other numbers of the tabs 235 or 335 could be used.

From the foregoing, it can be seen that there has been provided an improved reversible ratcheting screwdriver which is of simple and economical construction and ergonomic design and which permits both actuation of the reversing mechanism and spinning of the shank with the same hand used to grip the handle.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. In a ratcheting driver including a handle having a generally cylindrical working end with a predetermined radius, a reversible ratchet mechanism carried by the working end of the handle and operable in forward and reverse ratcheting modes, the ratchet mechanism defining a bore having an axis, and an elongated shank receivable coaxially in the bore and engageable with the ratchet mechanism and responsive to rotation of the handle for rotation with the handle in a first direction and for ratcheting rotation relative to the handle in a second direction opposite to the first direction, wherein the first direction is either a forward direction or a reverse direction depending on the ratcheting mode, the improvement comprising: a cylindrical reversing member disposed adjacent to the working end of the handle coaxially with the bore for rotation relative to the shank and coupled to the ratchet mechanism for shifting between the forward and reverse ratcheting modes, said reversing member having an exposed outer peripheral surface including a raised lobe portion projecting radially outwardly beyond the working end of the handle a predetermined distance sufficient to permit easy rotation of said reversing member by engagement of the lobe portion with the finger and/or thumb of a user's hand gripping the handle.

2. The driver of claim 1, wherein said raised lobe portion is arcuate in shape and is non-coaxial with the bore.

3. The driver of claim 1, wherein said outer peripheral surface includes a plurality of circumferentially spaced raised lobe portions each projecting radially outwardly beyond the working end of the handle a predetermined distance sufficient to permit easy rotation of said reversing member by engagement of a lobe portion with the finger and/or thumb of a user's hand gripping the handle.

4. The driver of claim 3, wherein said outer peripheral surface includes a plurality of recessed portions circumferentially alternating with said raised lobe portions.

5. The driver of claim 3, wherein each of said raised lobe portions has an axial extent greater than that of the remainder of said outer peripheral surface, said raised lobe portions being circumferentially spaced apart less than 180°.

6. The driver of claim 1, wherein said outer peripheral surface includes at least one frictional gripping portion projecting radially outwardly beyond the working end of the handle a distance less than said predetermined distance.

7. The driver of claim 1, wherein said raised lobe portion has an axial extent greater than that of the remainder of said outer peripheral surface.

8. The driver of claim 1, wherein said reversing member is generally cup-shaped, having a radially outwardly extending annular flange, said outer peripheral surface being formed on said flange.

9. The driver of claim 1, and further comprising a cylindrical spinner fixed to the shank coaxially therewith and having a maximum outer radius approximately the same as the predetermined radius, said reversing member being disposed between said spinner and the working end of the handle.

10. In a ratcheting driver including a handle having a generally cylindrical working end with a predetermined radius, a reversible ratchet mechanism carried by the working end of the handle and operable in forward and reverse ratcheting modes, the ratchet mechanism defining a bore having a first axis, the handle having a grip portion extending along a second axis inclined at a predetermined angle with respect to the first axis generally in a pistol grip configuration, and an elongated shank receivable coaxially in the bore and engageable with the ratchet mechanism and responsive to rotation of the handle for rotation with the handle in a first direction and for ratcheting rotation relative to the handle in a second direction opposite to the first direction, wherein the first direction is either a forward direction or a reverse direction depending on the ratcheting mode, the improvement comprising: a cylindrical reversing member disposed adjacent to the working end of the handle coaxially with the bore for rotation relative to the shank and coupled to the ratchet mechanism for shifting between the forward and reverse ratcheting modes, said reversing member having an exposed outer peripheral surface including a raised lobe portion projecting radially outwardly beyond the working end of the handle a predetermined distance sufficient to permit easy rotation of said reversing member by engagement of the lobe portion with the finger and/or thumb of a user's hand gripping the handle, said lobe portion being disposed in use on a side of the working end of the handle opposite from the direction in which the grip portion extends.

11. The driver of claim 10, wherein said outer peripheral surface includes a plurality of circumferentially spaced raised lobe portions each projecting radially outwardly beyond the working end of the handle a predetermined distance sufficient to permit easy rotation of said reversing member by engagement of a lobe portion with the finger and/or thumb of a user's hand gripping the handle, each of said raised lobe portions being disposed in use generally on a side of the working end of the handle opposite from the direction in which the grip portion extends.

12. The driver of claim 11, wherein said raised lobe portions are four in number.

13. The driver of claim 11, wherein the number of said raised lobe portions is two.

14. The driver of claim 13, wherein each of said raised lobe portions has an axial extent greater than that of the remainder of said outer peripheral surface.

15. The driver of claim 10, wherein said raised lobe portion has an axial extent greater than that of the remainder of said outer peripheral surface.

16. In a ratcheting driver including a handle having a generally cylindrical working end with a predetermined radius, a reversible ratchet mechanism carried by the working end of the handle and operable in forward and reverse ratcheting modes, the ratchet mechanism defining a bore having an axis, and an elongated shank receivable coaxially in the bore and engageable with the ratchet mechanism and responsive to rotation of the handle for rotation with the handle in a first direction and for ratcheting rotation relative to the handle in a second direction opposite to the first direction, wherein the first direction is either a forward direction or a reverse direction depending on the ratcheting mode, the improvement comprising: a cylindrical reversing member disposed adjacent to the working end of the handle coaxially with the bore for rotation relative to the shank and coupled to the ratchet mechanism for shifting between the forward and reverse ratcheting modes, said reversing member having an exposed outer peripheral surface including a raised lobe portion projecting radially outwardly beyond the working end of the handle a predetermined distance sufficient to permit easy rotation of said reversing member by engagement of the lobe portion with the finger and/or thumb of a user's hand gripping the handle, said lobe portion having sloping sides and serrations formed on said sloping sides.

17. The driver of claim 16, wherein said raised lobe portion has a crest joining said sloping sides, said serrations extending along said crest.

18. The driver of claim 16, wherein said outer peripheral surface includes a plurality of circumferentially spaced raised lobe portions each projecting radially outwardly beyond the working end of the handle a predetermined distance sufficient to permit easy rotation of said reversing member by engagement of a lobe portion with the finger and/or thumb of a user's hand gripping the handle.

19. The driver of claim 18, wherein said outer peripheral surface includes a plurality of recessed portions circumferentially alternating with said raised lobe portions.

20. The driver of claim 16, wherein said outer peripheral surface includes at least one frictional gripping portion projecting radially outwardly beyond the working end of the handle a distance less than said predetermined distance.

21. In a ratcheting driver including a handle having a generally cylindrical working end with a predetermined radius, a reversible ratchet mechanism carried by the working end of the handle and operable in forward and reverse ratcheting modes, the ratchet mechanism defining a bore having an axis, and an elongated shank receivable coaxially in the bore and engageable with the ratchet mechanism and responsive to rotation of the handle for rotation with the handle in a first direction and for ratcheting rotation relative to the handle in a second direction opposite to the first direction, wherein the first direction is either a forward direction or a reverse direction depending on the ratcheting mode, the improvement comprising: a cylindrical reversing member disposed adjacent to the working end of the handle coaxially with the bore for rotation relative to the shank and coupled to the ratchet mechanism for shifting between the forward and reverse ratcheting modes, said reversing member having an outer peripheral surface with a frictional gripping portion thereon, said outer peripheral surface having an axial width of at least 0.2 inch.

22. The driver of claim 21, wherein said frictional gripping portion includes a raised lobe portion projecting radially outwardly beyond the working end of the handle a predetermined distance sufficient to permit easy rotation of said reversing member by engagement of the lobe portion with the finger and/or thumb of the user's hand gripping the handle.

23. The driver of claim 22, wherein the axial width of said outer peripheral surface is at least twice the predetermined distance.

24. The driver of claim 21, wherein said frictional gripping portion includes a plurality of circumferentially spaced raised lobe portions each projecting radially outwardly beyond the working end of the handle a predetermined distance sufficient to permit easy rotation of said reversing member by engagement of the lobe portion with the finger and/or thumb of a user's hand gripping the handle, said outer peripheral surface further including a plurality of recessed portions circumferentially alternating with said raised lobe portions.

25. The driver of claim 24, wherein each of said raised lobe portions has a serrated outer surface.

* * * * *